US005832351A

United States Patent [19]

Takekoshi et al.

[11] Patent Number: 5,832,351

[45] Date of Patent: Nov. 3, 1998

[54] TRANSFER SHEET AND IMAGE FORMING APPARATUS

[75] Inventors: Nobuhiko Takekoshi; Rie Takekoshi, both of Kawasaki, Japan

[73] Assignee: Canon Kabushiki Kaisha, Tokyo, Japan

[21] Appl. No.: 678,958

[22] Filed: Jul. 12, 1996

[30] Foreign Application Priority Data

Jul. 13, 1995 [JP] Japan ..... 7-200497

[51] Int. Cl.[6] ..... G03G 15/16

[52] U.S. Cl. ..... 399/303; 399/298; 399/302; 399/313; 430/126

[58] Field of Search ..... 399/303, 302, 399/308, 313, 298, 299, 312, 149; 430/126

[56] References Cited

U.S. PATENT DOCUMENTS

| | | | |
|---|---|---|---|
| 4,370,379 | 1/1983 | Kato et al. | 430/126 X |
| 5,053,827 | 10/1991 | Tompkins et al. | 399/302 |
| 5,298,956 | 3/1994 | Mammino et al. | 399/308 |
| 5,390,012 | 2/1995 | Miyashiro et al. | 399/303 |
| 5,410,390 | 4/1995 | Miura et al. | 399/303 |
| 5,428,429 | 6/1995 | Fletcher | 399/308 |
| 5,452,063 | 9/1995 | Fletcher | 399/308 |
| 5,552,871 | 9/1996 | Kutsuwada et al. | 399/313 |
| 5,572,304 | 11/1996 | Seto et al. | 399/313 |
| 5,623,330 | 4/1997 | Ishibashi | 430/126 X |
| 5,631,725 | 5/1997 | Harasawa et al. | 399/312 X |
| 5,640,660 | 6/1997 | Takano et al. | 399/313 |
| 5,655,199 | 8/1997 | Yamashita et al. | 399/302 |

FOREIGN PATENT DOCUMENTS

| | | |
|---|---|---|
| 54-1055479 | 8/1979 | Japan . |
| 1-261138 | 10/1989 | Japan . |
| 6-140712 | 5/1994 | Japan . |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

The present invention provides an image forming apparatus having an image bearing member for bearing an image, and a transfer material bearing member for bearing a transfer material to which the image is transferred from the image bearing member, and wherein volume resistivity of the transfer material bearing member is $10^{14}$ Ωcm or more, and surface resistivity of upper and lower surfaces of the transfer material bearing member is $10^{7}$ to $10^{13}$ Ω/□.

15 Claims, 8 Drawing Sheets

TRANSFER SHEET AND IMAGE FORMING APPARATUS

BACKGROUND OF THE INVENTION

1. Field of the Invention

The present invention relates to an image forming apparatus such as an electrostatic copying machine, an electrostatic printer and the like, and a transfer sheet such as a transfer material bearing sheet provided within such an image forming apparatus.

2. Description of the Related Art

There have been proposed various image forming apparatuses and methods, including a process for successively transferring toner images onto a single transfer material in a superimposed fashion. FIG. 11 is an elevational sectional view showing an example of such a conventional image forming apparatus. Now, the conventional image forming apparatus will be explained.

An endless belt (transfer belt) 8*c* moved in a direction shown by the arrow X in FIG. 11 is disposed within a body of the image forming apparatus. A transfer material 6 supplied from a cassette 60 is sent to the transfer belt 8*c* through a pair of regist rollers 13, and, then, the transfer material is conveyed in the direction X by the transfer belt 8*c*. In this example, four image forming portions Pa, Pb, Pc and Pd having the same construction are disposed above the transfer belt 8*c* and are arranged side by side.

The image forming portion Pa includes a rotatable cylindrical image bearing member 1*a* around which a first charger 2*a*, a developing device 3*a* and a cleaner 5*a* are disposed. These elements 2*a*, 3*a* and 5*a* constitute an image forming means. The image forming portions Pb, Pc and Pd have similar image forming means, respectively. In FIG. 11, the image bearing members 1*b*, 1*c*, 1*d* are merely shown. In the developing devices of the image forming portions Pa, Pb, Pc and Pd, magenta toner, cyan toner, yellow toner and black toner are contained, respectively. Since the image forming portions Pa to Pd have the same construction, the first image forming portion Pa is mainly explained hereinafter.

After a surface of the image bearing member 1*a* is uniformly charged, an image signal having a magenta color component (of an original) is illuminated onto the image bearing member 1*a* through a polygon mirror 17 and the like, thereby forming an electrostatic latent image corresponding to the magenta color component on the image bearing member 1*a*. Then, the latent image is developed by the developing device 3*a* with magenta toner to form a magenta toner image. As the image bearing member 1*a* is rotated, when the magenta toner image reaches a transfer station where the image bearing member 1*a* is contacted with the transfer belt 8*c*, the transfer material 6 supplied from the cassette 60 also reaches the transfer station by being conveyed by the transfer belt 8*c*. In this condition, by transfer bias applied from a transfer charge means 4*a*, the magenta toner image on the image bearing member 1*a* is transferred onto the transfer material 6. Thereafter, the residual toner remaining on the image bearing member 1*a* is removed by the cleaner 5*a*. Then, the residual charges remaining on the image bearing member 1*a* are removed by a pre-exposure means 21*a* for preparing for the next image formation.

Before the transfer material 6 bearing the magenta toner image is conveyed to the next image forming portion Pb by the transfer belt 8*c*, a cyan toner image is formed on the image bearing member 1*b* in a manner similar to the above-mentioned manner. Then, the cyan toner image is transferred onto the magenta toner image on the transfer material 6 in a superimposed fashion at a transfer station of the image forming portion Pb. Similarly, as the transfer belt is passing through the image forming portions Pc, Pd, a yellow toner image and a black toner image are successively transferred onto the transfer material 6 in a superimposed fashion at their transfer stations, respectively.

Thereafter, the transfer material 6 is separated from a downstream end of the transfer belt 8*c* under the action of a separation charger 41, and the separated transfer material is sent to a fixing device 7. The fixing device 7 includes a fixing roller 71 and a pressure roller 72 urged against the fixing roller. While the transfer material 6 is being passed between a nip between the fixing roller and the pressure roller, four color toner images are fused and mixed by heat and pressure, thereby fixing a full-color image to the transfer material. Then, the transfer material is discharged out of the color image forming apparatus as a full-color print.

A cleaning device 9 having an electricity removal charger 12 and a cleaning fur brush 162 is disposed in a return path of the transfer belt 8*c*, thereby removing the residual charges and toner remaining on the transfer belt 8*c*.

The transfer belt 8*c* is made of dielectric resin such as polyethylene terephthalate (PET) resin, polyvinylidene fluoride (PVdF) resin, polycarbonate (PC) resin, polyurethane (PU) resin, polyimide (PI) resin, or rubber, and such dielectric resin includes conductive filler so that the transfer belt has proper electric feature and strength. That is to say, the transfer belt 8*c* is generally divided into the following three types on the basis of the material:

Type 1: The resin or rubber is used as high resistance material;

Type 2: Conductive filler is mixed with the resin or rubber of Type 1, so that middle resistance material is used; and Type 3: The material of Type 1 or Type 2 is coated on the metal layer or a conductive layer, or a surface layer is post-finished, so that an electrical and mechanical multi-layer structure is used.

However, in the conventional image forming apparatus shown in FIG. 11, there arose a problem that, when the toner image transferred to the transfer material at a certain transfer station passes through the next image bearing member, the toner image is re-transferred onto the image bearing member. In particular, when a different color is reproduced by superimposing two or more color toner images on the transfer material, there is the tendency that the lastly transferred toner image is apt to be re-transferred onto the image bearing member more than the formally or previously transferred toner image. This tendency will now be described with reference to the accompanying drawings.

In the image forming apparatus shown in FIG. 11, when the magenta (M) toner image, cyan (C) toner image, yellow (Y) toner image and black (Bk) toner image are successively transferred, it is assumed that a blue (B) color is reproduced by the superimposing of the magenta color and the cyan color. When the cyan toner image (upper layer) lastly transferred to the transfer material 6 passes through the downstream image bearing members 1*c*, 1*d*, the cyan toner image is re-transferred onto these image bearing members 1*c*, 1*d*, with the result that the blue image on the transfer material is changed to the totally or partially magenta color image. Similarly, when a green (G) color is reproduced by superimposing of the magenta color and the yellow color, the upper layer or yellow toner image is re-transferred onto the downstream image bearing member 1*d*, with the result that the green image is changed to the totally or partially magenta color image.

To cope with such color change, conventionally, the toner images were transferred from a quiet color, or parameters of an input signal and an output signal of the image were made optimum. However, even when these countermeasures were adopted, if the transfer material included less moisture to easily cause the re-transferring such as in a low humidity condition or in a both-face copy mode, the color change due to the partial re-transferring was generated, thereby causing the poor image.

According to the inventor's investigation, it was found that, in case of the transfer material including less moisture such as in the low humidity condition, although the color change is generated due to the re-transferring as mentioned above, if the environment is in the low humidity condition, when the transfer material is separated from the image bearing member, peel discharge is caused from the charge means due to vibration of the rotating transfer belt, with the result that a local reversely-charged portion is formed on the transfer belt, which leads to the poor toner image quality (including the color change due to the re-transferring).

SUMMARY OF THE INVENTION

An object of the present invention is to provide a transfer sheet and an image forming apparatus, in which charge attenuation features of a transfer material bearing member and an intermediate transfer member such as the transfer sheet are made optimum.

Another object of the present invention is to provide a transfer sheet and an image forming apparatus, in which unevenness in charging of an image borne on a transfer material bearing member and an intermediate transfer member such as the transfer sheet is suppressed.

A further object of the present invention is to provide a transfer sheet and an image forming apparatus, in which the re-transferring is suppressed at a transfer material bearing member and an intermediate transfer member such as the transfer sheet to obtain a high quality image.

The other objects and features of the present invention will be apparent from the following detailed description of the invention referring to the accompanying drawings.

DETAILED DESCRIPTION OF THE PREFERRED EMBODIMENTS

The present invention will now be explained in connection with embodiments (transfer sheet and image forming apparatus) thereof with reference to the accompanying drawings.

First of all, a preferred embodiment of the present invention will be described.

Figure 1:
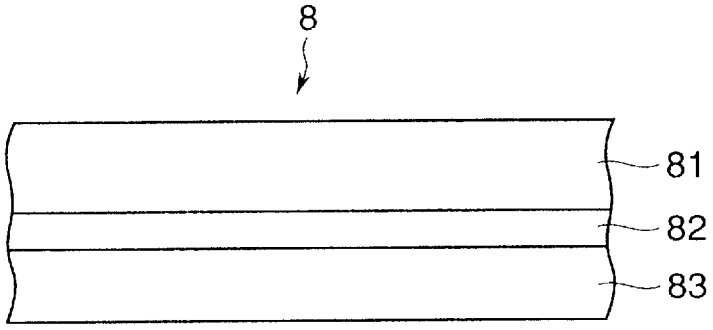
FIG. 1 is a partial sectional view of a transfer belt according to a preferred embodiment of the present invention.
Figure 5:
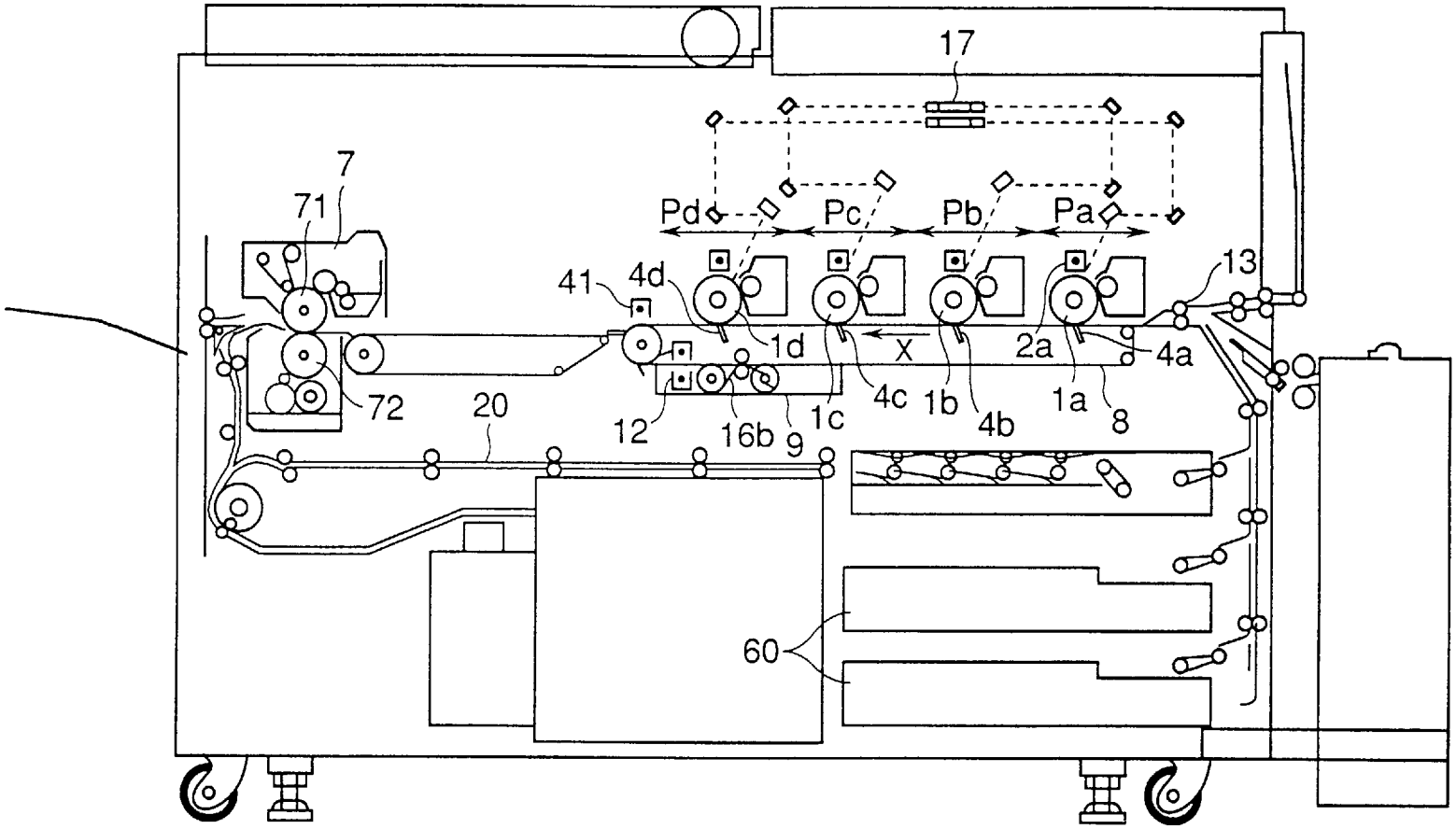
FIG. 5 is an elevational sectional view of an image forming apparatus having the transfer belt of FIG. 1.

FIG. 1 is a partial sectional view of a transfer belt according to a preferred embodiment of the present invention, and FIG. 5 is an elevational sectional view of an image forming apparatus having the transfer belt of FIG. 1. The transfer belt 8 is a multi-layer transfer belt of the above-mentioned Type 3. As shown in FIG. 1, the transfer belt 8 comprises an upper layer 81, an intermediate layer 82 and a lower layer 83.

In the present invention, a sheet-shaped transfer material bearing member such as the transfer belt 8 is constituted by a multi-layer structure to have volume resistivity of $10^{14}$ Ωcm or more and surface (upper and lower surfaces) resistivity of $10^{7}$–$10^{13}$ Ω/□ to thereby make the charging attenuation feature optimum, so that a toner image once transferred to the transfer material is prevented from being re-transferred to downstream image bearing member(s), i.e., the disadvantages caused due to leakage of an electric field during the charging of the transfer material bearing member.

Now, a construction and an operation of the image forming apparatus having the transfer belt of FIG. 1 will be explained.

An endless belt (transfer belt) 8 acting as a transfer material bearing member and moved in a direction shown by the arrow X is disposed within a body of the image forming apparatus. A transfer material supplied from a cassette 60 is sent to the transfer belt 8 through a pair of regist rollers 13, and then, the transfer material is conveyed in the direction X by the transfer belt 8. Four image forming portions Pa, Pb, Pc and Pd having the same construction are disposed above the transfer belt 8 and are arranged side by side.

The image forming portion Pa includes a rotatable cylindrical image bearing member 1*a* having an organic photoconductive layer having negative charging polarity around which a first charger 2*a* and a developing device 3*a* are disposed. These elements 2*a* and 3*a* constitute an image forming means. The image forming portions Pb, Pc and Pd have similar image forming means, respectively. In the developing devices of the image forming portions Pa, Pb, Pc and Pd, magenta toner, cyan toner, yellow toner and black toner are contained, respectively. Since the image forming portions Pa to Pd have the same construction, the first image forming portion Pa is mainly explained hereinafter.

After a surface of the image bearing member 1 is uniformly charged negatively, an image signal having a magenta color component (of an original) is inputted to a laser scanner and then is illuminated onto the image bearing member 1*a* through a polygon mirror 17 and the like, thereby forming an electrostatic latent image corresponding to the magenta color component on the image bearing member 1*a*. Then, the latent image is reversely developed by the developing device 3*a* with positively-charged magenta toner to form a magenta toner image. As the image bearing member 1*a* is rotated, when the magenta toner image reaches a transfer station where the image bearing member 1*a* is contacted with the transfer belt 8, the transfer material supplied from the cassette 60 also reaches the transfer station by being conveyed by the transfer belt 8. In this condition, by transfer bias applied from a transfer charge means (for example, a transfer blade contacted with an inner surface of the transfer belt 8) 4*a*, the magenta toner image on the image bearing member 1*a* is transferred onto the transfer material.

Thereafter, the image bearing member 1*a* having the residual toner thereon is uniformly charged by the charger 2*a* negatively. Then, the image bearing member is image-exposed by the laser scanner to form an electrostatic latent image thereon. Then, by applying developing bias voltage (between dark portion potential and bright portion potential of the electrostatic latent image formed on the image bearing member 1*a*) to a developing sleeve of the developing device 3*a*, the toner is transferred from the developing sleeve to the bright portions, and, at the same time, the residual toner is transferred from the dark portions to the developing sleeve, thereby cleaning the image bearing member. That is to say, the developing device 3*a* performs both the developing operation and the cleaning operation.

Before the transfer material bearing the magenta toner image is conveyed to the next image forming portion Pb by the transfer belt 8, a cyan toner image is formed on the image bearing member 1*b* in a manner similar to the above-mentioned manner. Then, the cyan toner image is transferred onto the magenta toner image on the transfer material in a superimposed fashion at a transfer station of the image forming portion Pb. Similarly, as the transfer material borne on the transfer belt 8 is passing through the image forming portions PC, Pd, a yellow toner image and a black toner image are successively transferred onto the transfer material in a superimposed fashion at their transfer stations, respectively. Incidentally, the developing devices of the image forming portions Pb, Pc and Pd can perform both the developing operation and the cleaning operation, as is in the developing device 3*a*.

Thereafter, the transfer material is separated from a downstream end of the transfer belt 8 under the action of a separation charger 41, and the separated transfer material is sent to a fixing device 7. The fixing device 7 includes a fixing roller 71 and a pressure roller 72 urged against the fixing roller. While the transfer material is being passed between a nip between the fixing roller and the pressure roller, four color toner images are fused and mixed by heat and pressure, thereby fixing a full-color image to the transfer material. Then, the transfer material is discharged out of the color image forming apparatus as a full-color print.

A cleaning device 9 having an electricity removal charger 12 and a cleaning web 16*b* is disposed in a return path of the transfer belt 8, thereby removing the residual charges and toner remaining on the transfer belt 8.

The image forming apparatus according to the illustrated embodiment includes a convey portion 20 for conveying the transfer material to the image forming portions again so that an image can be formed on the other surface (back surface) of the transfer material on which the image was formed. The image formation regarding the back surface of the transfer material is effected in a similar manner to the image formation regarding the front surface of the transfer material, after the image is fixed to the front surface of the transfer material.

Now, an electric feature and a transferring feature of the transfer belt will be explained. It is preferable that, regardless of the above-mentioned Types 1 to 3, the transfer belt has a certain common electric feature in order to obtain the good transferred images. For example, if the surface resistivity (ρs) of the transfer belt is too small, the transfer electric field applied during the transferring operation will be influenced by a surrounding potential condition, with the result that the transferring operation becomes unstable or the electric field leaks to the surroundings, thereby worsening the transferring efficiency. This disadvantage will be fully explained in connection with the case where the image is formed in the first image forming portion 1*a* of the conventional image forming apparatus shown in FIG. 11 and the image forming apparatus shown in FIG. 5.

The transfer material supplied from the cassette 60 is conveyed between the image bearing member 1*a* and the transfer charger 4*a* by the rotation of the transfer belt 8 (8*a*). In this case, if a tip end of the transfer material exists between the image bearing member 1*b* and the transfer charger 4*b* of the next image forming portion Pb or if a trailing end of the transfer material exists between the pair of regist rollers 13, the transfer electric field from the transfer charger 4*a* tends to leak toward the image bearing member 1*b* or toward the paired regist rollers 13.

As a result, since an amount of the transfer electric field contributing to the transferring is differentiated between a case where the transfer electric field of the transfer charger 4*a* connected to a high voltage source leaks and a case where such transfer electric field does not leak, the difference in image density depending upon the conveying condition of the transfer material will occur. Such image density change occurs not only due to the transfer charger 4*a* but also due to the transfer chargers 4*b* to 4*d* of the other image forming portions Pb to Pd, and also occurs when the electric field of the separation charger 41 connected to a high voltage source interferes with the electric field for the transferring of the last color.

If the surface resistivity ρs of the transfer material bearing member (transfer belt) is small, as mentioned above, not only the interference between the adjacent electric fields occurs, but also the toner on the image bearing member is scattered toward the transfer material to transfer the toner to the transfer material, with the result that the accuracy of the transferring position of the toner image is worsened, and, thus, the sharpness of the transferred image is deteriorated.

On the other hand, if the surface resistivity ρs of the transfer belt is great, the charge attenuation amount is reduced. Accordingly, in the example shown in FIG. 5, when the transfer charging of the transfer belt 8 is repeated from the first image forming portion Pa to the fourth image forming portion Pd, in the last image forming portion Pd, the great electric power is required to charge the transfer belt 8. When the constant current control of the transfer charger is effected upon the transferring, if the surface resistivity ρs is great, the higher voltage is required. Thus, not only the power consumption and the apparatus cost are increased, but also a discharge phenomenon is apt to occur during the transferring operation, with the result that the good transferred image is not obtained and/or the latitude of the optimum transfer electric field is narrowed.

Similarly, if volume resistivity (ρv) of the transfer belt 8 is great, the charged amount of the transfer belt charged by the transfer chargers 4*a* to 4*d* during the transferring becomes great, and, thus, the surface potential of the transfer belt becomes great. In this case, in the conventional transfer belt 8*c*, since the surface resistivity ρs generally becomes great, there is substantially no potential attenuation. Thus, by repeating the charging, the charges on the transfer belt are saturated, and the disadvantage similar to the great surface resistivity occurs.

On the other hand, if the volume resistivity ρv of the transfer belt 8 is small, the charge potential is not increased, and, thus, the holding force of the transfer belt for holding the transfer material and the toner is decreased. As a result, poor transferring occurs or, if the current from the transfer chargers 4*a* to 4*d* directly flows to the image bearing members 1*a* to 1*d*, a disadvantage such as drum memory will occur. These disadvantages occur not only in the image forming apparatus shown in FIG. 5 but also in image forming apparatuses shown in FIGS. 7 and 8 in common, which will be described later.

Regarding the electric feature of the transfer bearing member such as the transfer belt, transfer material bearing sheet and the like, the volume resistivity ρv of the transfer bearing member is set to more than $10^{14}$ Ωcm to generate the charge potential of the transfer bearing member, and, the attenuation of the charge amount is enhanced by decreasing the surface resistivity ρs to $10^7$ to $10^{13}$ Ω/□, thereby preventing the charge-up during the charging. Due to such attenuation of the charge amount, the uneven charging which is caused by the peel discharge can be suppressed. If the surface resistivity ρs is smaller than $10^7$ Ω/□, before the charges are accumulated, the current will flow laterally due to the electric field interference. Further, since the charges are not accumulated, a force for absorbing the transfer material becomes too weak to hold the transfer material adequately. As a result, deviation between colors and poor conveyance of the transfer material will occur.

Since the lower limit value $10^7$ Ω/□ of the surface resistivity ρs is generally greater than the surface resistivity of the transfer material as used in the present invention, at least electric field interference which is caused by the transfer bearing member is not generated. The upper limit value $10^{13}$ Ω/□ of the surface resistivity ρs is included within a range capable of achieving the above-mentioned effect, from the consideration described hereinbelow. The surface resistivity is preferably $10^{10}$ to $10^{11}$ Ω/□.

The transfer belt was constituted by the multi-layer structure of the above-mentioned Type 3 in which the volume resistivity ρv and surface resistivity ρs can be easily adjusted, and the three layer structure as shown in FIG. 1 was examined. The material of the transfer bearing member was polycarbonate having substantial mechanical strength and in which resistance can easily be adjusted by carbon filler, and the carbon filler was kechen black. When the polycarbonate sheets including the carbon filler were laminated, if the surface layer 81 in FIG. 1 had low resistance, it was found that the absorbing force for holding the transfer material was decreased. If the lower layer 83 had also low resistance as is in the surface layer 81, it was found that the disadvantage such as interference occurred.

Regarding a method for measuring the resistance of the transfer belt, the configuration of the electrodes and the measuring procedure were based on JIS K6911 standard. Voltage of 1 kV was applied to the transfer belt, and the surface resistivity ρs was measured while the front surface of the transfer belt blank was being disposed at the surface electrode side, and, when the back surface was measured, the transfer belt blank was turned up. When the volume resistivity of the intermediate layer 82 of the transfer belt 8 was $10^3$ to $10^7$ Ωcm (conductive), the volume resistivity of the upper and lower layers 81, 83 sandwiching the intermediate layer was $10^9$ Ωcm or more, the volume resistivity of the entire transfer belt 8 was $10^{14}$ Ωcm, and the surface resistivity of the front and back surfaces of the transfer belt 8 (i.e. surface resistivity of the upper and lower layers 81, 83) was $10^7$ to $10^{13}$ Ω/□, the effect of the present invention could be obtained.

In this case, when the transfer belts having the entire thickness of 100 μm, 150 μm, 200 μm were used and binder layers having substantially the same resistance as that of the intermediate layer 82 were used between the layers of the transfer belts, it was found that the electric features, such as entire volume resistivity of the belts, were almost not changed.

By using the transfer belt having the above-mentioned electric feature, since the toner can be prevented from re-transferring onto the image bearing member, the exclusive cleaner for the image bearing member can be omitted. As shown in FIG. 5, in the apparatus in which the developing devices also act as cleaners, although the mixing of colors occurs if the first color toner due to the re-transferring enters into the second color toner in the developing device 3*b*, by preventing the re-transferring of the toner, a compact image forming apparatus in which the mixing of colors does not occur can be provided.

Figure 11:
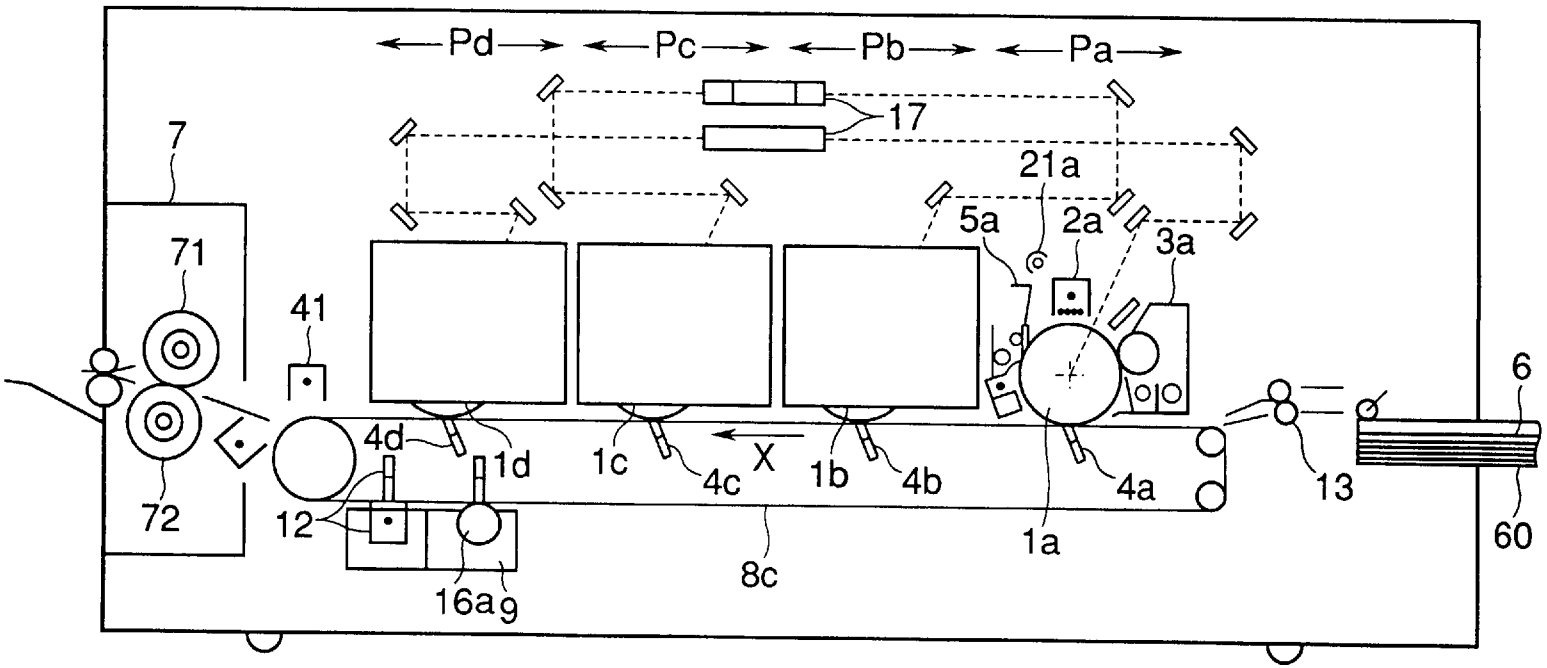
FIG.11 PRIOR ART
FIG. 11 is an elevational sectional view of a conventional image forming apparatus.

Incidentally, the transfer belt 8 having the above-mentioned electric feature may be used as the transfer belt 8*c* of the image forming apparatus shown in FIG. 11.

Figure 7:
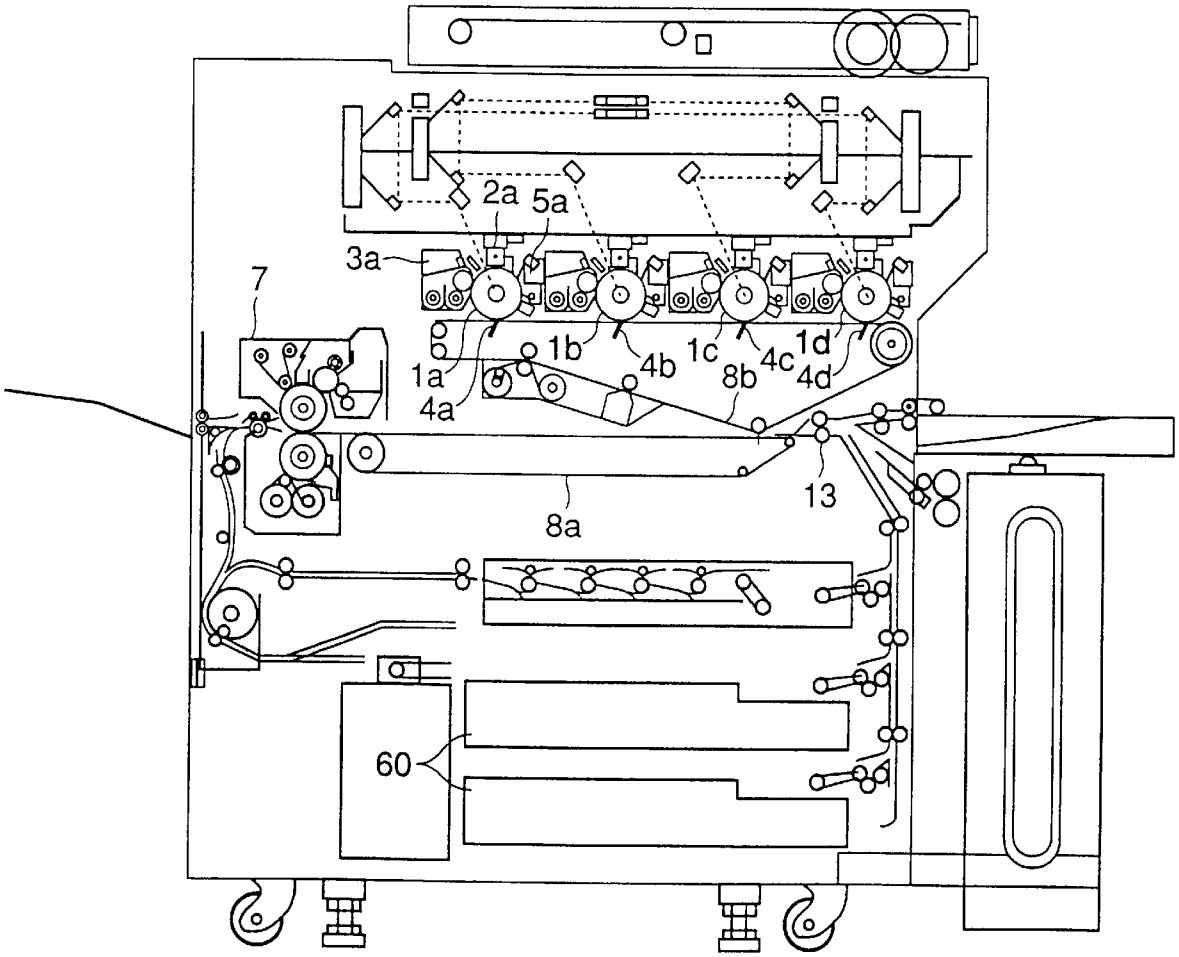
FIG. 7 is an elevational sectional view of an image forming apparatus to which the present invention can be applied.

As mentioned above, the problem that the difference in density is caused between the case where the transfer electric field of the transfer charger leaks and the case where the transfer electric field of the transfer charger does not leak also occurs in the image forming apparatus shown in FIG. 7. Accordingly, the transfer belt 8 having the above-mentioned electric feature may be used as an intermediate transfer belt 8*b* and/or a transfer belt 8*a* of FIG. 7.

The apparatus shown in FIG. 7 includes the image bearing members 1*a* to 1*d*, and further includes a sheet-like intermediate transfer belt (intermediate transfer member) 8*b* contacted with the image bearing members 1*a* to 1*d* and a sheet-like transfer belt (transfer material bearing member) 8*a* contacted with the intermediate transfer belt. As is in the image bearing members 1*a* to 1*d* of the image forming apparatus of FIG. 5, a magenta toner image, a cyan toner image, a yellow toner image and a black toner image are formed on the image bearing members 1*a* to 1*d* of FIG. 7. The color toner images are directly transferred from the image bearing members 1*a* to 1*d* onto the intermediate transfer belt 8*b* in a superimposed fashion. Accordingly, the four color toner images are superimposed on the intermediate transfer belt 8*b*, and, the transfer material is sent to the transfer station of the transfer belt 8*a* by the pair of regist rollers 13 so that the superimposed toner images are collectively transferred from the intermediate transfer belt 8*b* onto the transfer material. The transfer material to which the four color toner images were transferred is conveyed to the fixing device 7 while being supported by the transfer belt 8*a*.

The transfer belt 8 shown in FIG. 1 may be used as the intermediate transfer belt 8*b* and the transfer belt 8*a*.

On the other hand, the transfer sheet (transfer belt) 8 can be used in image forming apparatuses other than the image forming apparatus having the plurality of image bearing members. That is to say, the transfer sheet can be used in an image forming apparatus having a single image bearing member (photosensitive member) as shown in FIG. 8.

Figure 8:
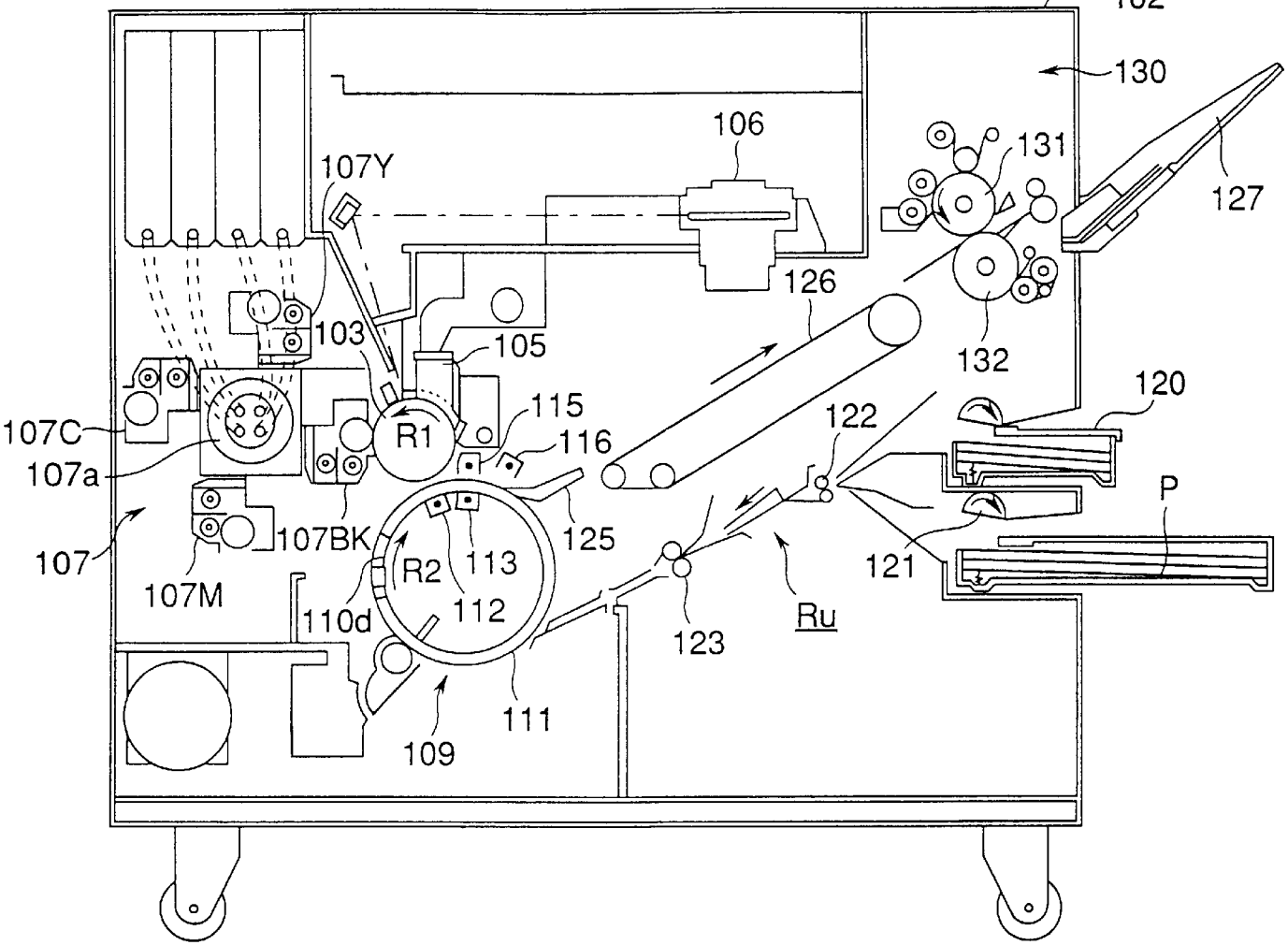
FIG. 8 is an elevational sectional view of another image forming apparatus to which the present invention can be applied.

The image forming apparatus shown in FIG. 8 is a laser beam printer. In this laser beam printer, an image bearing member 103 rotated in a direction shown by the arrow R1 is disposed at a central portion within a body 102 of the printer, and, a first charger 105, a laser beam exposure device 106 and a rotatable developing means 107 are disposed around the image bearing member. The rotatable developing means 107 comprises a rotary member 107*a* supported by the body 102 of the apparatus, and four developing devices mounted on the rotary member 107*a*, i.e., magenta developing device 107M, cyan developing device 107C, yellow developing device 107Y and black developing device 107Bk. By rotating the rotary member 107*a*, a selected one of the developing devices is brought to a developing station where the selected developing device is opposed to the image bearing member 103 so that the latent image can be developed with color toner included in the selected developing device.

Figure 9:
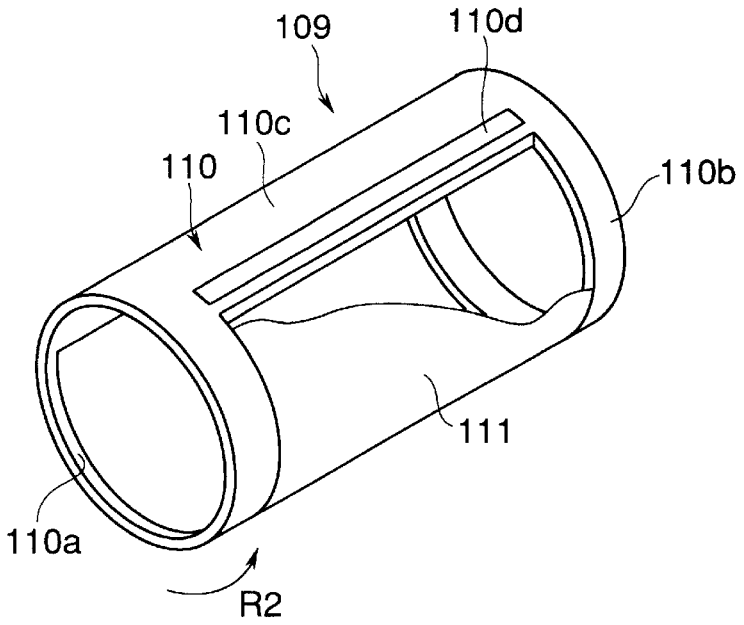
FIG. 9 is a perspective view of a transfer drum used with the apparatus of FIG. 8.

A transfer drum 109 is disposed below the image bearing member 103. As shown in FIG. 9, the transfer drum comprises a pair of annular cylinders 110*a*, 110*b*, a frame-like base member 110 including a connection member 110*c* connecting between the cylinders, and a transfer material bearing sheet 111 cylindrically mounted around the base member 110. The transfer material bearing sheet 111 acts as a transfer material bearing member for bearing the transfer material and is formed from dielectric film made of polyethylene terephthalate or polyvinylidene fluoride resin, for example. That is, the transfer material bearing sheet may be the same as the transfer belt 8 shown in FIG. 5. Alternatively, the transfer belt 8 shown in FIG. 1 may be used as the transfer material bearing sheet 111.

A transfer material gripper 110*d* is attached to the connection member 110*c*. The transfer material gripper 110*d* has one longitudinal edge slightly spaced apart from the connection member 110*c* so that a tip end of the transfer material P can be gripped between the transfer material gripper and the connection member.

Briefly explaining the full-color (four colors) image forming process of the laser beam printer having the above-mentioned construction, while the photosensitive drum 103 is being rotated in a direction shown by the arrow R1, the surface of the photosensitive drum 103 is uniformly charged by the first charger 105. Then, the photosensitive drum 103 is exposed by image light corresponding to the magenta color emitted from the laser beam exposure device 106, thereby forming a latent image on the photosensitive drum. Then, the latent image is developed by the magenta developing device 107M of the developing means 107 to form a magenta toner image on the photosensitive drum 103.

On the other hand, the transfer material P is supplied from a sheet supply cassette 120 to a convey path Ru by a sheet supply roller 121. Then, the transfer material is conveyed to the transfer drum 109 through a pair of convey rollers 122 and a pair of regist rollers 123. The tip end of the transfer material P is gripped by the gripper 110*d*. The transfer material P (the tip end of which is gripped by the gripper) is closely contacted with the surface of the transfer drum 109 as the transfer drum 109 is rotated in a direction shown by the arrow R2.

Figure 10:
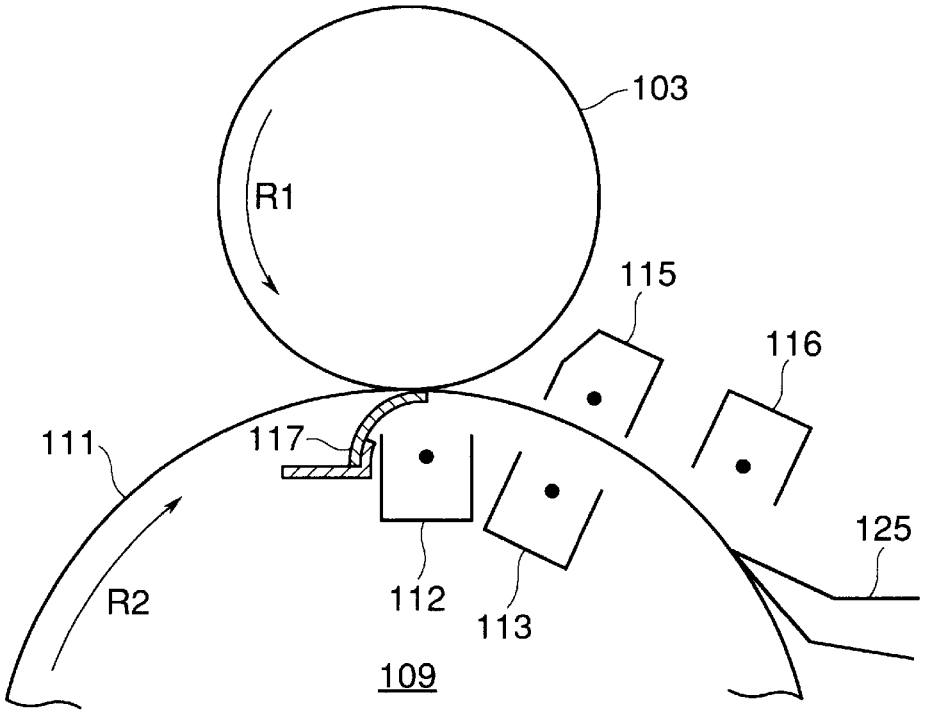
FIG. 10 is an enlarged sectional view showing a transfer station of the apparatus of FIG. 8.

The magenta toner image on the photosensitive drum 103 is transferred onto the transfer material P borne on the transfer drum 109. When the magenta toner image on the photosensitive drum 103 reaches a transfer station where the transfer drum 109 is contacted with the photosensitive drum 103, by applying corona discharge having polarity opposite to that of the toner to the back surface of the transfer material bearing sheet 111 by means of a transfer charger 112, the magenta toner image is transferred to the transfer material P borne on the transfer drum 109. In this case, as shown in FIG. 10, the back surface of the transfer material bearing sheet 111 is urged against the surface of the image bearing member 103 by a tip end of an urging member 117, thereby improving the transferring efficiency for transferring the toner image onto the transfer material P.

Similarly, the cyan toner image, yellow toner image and black toner image are successively transferred onto the same transfer material P supported on the transfer drum 109, so that the superimposed four color toner images form a full-color image on the transfer material P.

The transfer material P to which the four color toner images were transferred is separated from the transfer drum 109 by a separation pawl 125 while the electricity on the transfer material is being removed by inner and outer electricity removal chargers 113, 115 and 116. The separated transfer material P is conveyed to a fixing device 130 by a convey belt 126. In the fixing device 130, while the transfer material to which the toner images were transferred is being passed between a fixing roller 131 having a heater therein and a pressure roller 132, the toner is fused and mixed, thereby fixing a full-color permanent image to the transfer material P. Then, the transfer material is discharged onto a discharge tray 127.

In the image forming apparatus having the above-mentioned construction, after the transferring, when the transfer material is separated from the transfer belt, the leakage of the electric field is generated at the electricity removal chargers 113, 115 and 116. Accordingly, by using the transfer belt 8 having the multi-layer construction shown in FIG. 1 as the transfer material bearing sheet 111 and by making the charge attenuation feature of the belt optimum, the disadvantage caused by the leakage of the electric field can be eliminated.

In the above-mentioned embodiment, while the four color image forming apparatus was explained, also in an image forming apparatus in which an image is harmoniously reproduced with two colors, the transfer belt (transfer sheet) having the construction shown in FIG. 1 is effectively used as a transfer material bearing member such as a transfer belt or transfer sheet (transfer material bearing sheet) for bearing a transfer material, or, as an intermediate transfer member such as an intermediate transfer belt or intermediate transfer sheet to which the toner images are temporarily transferred before the toner images are transferred onto the transfer material.

Next, a second embodiment of the present invention will be explained.

The transfer sheet such as the above-mentioned transfer material bearing member and the intermediate transfer member is not limited to the multi-layer structure of Type 3 as shown in FIG. 1. Now, another embodiment of a transfer sheet such as a transfer material bearing member and a intermediate transfer member will be described.

Figure 2:
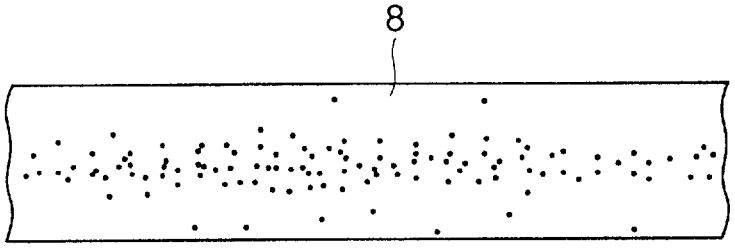
FIG. 2 is a partial sectional view of a transfer belt according to another embodiment of the present invention.
Figure 6:
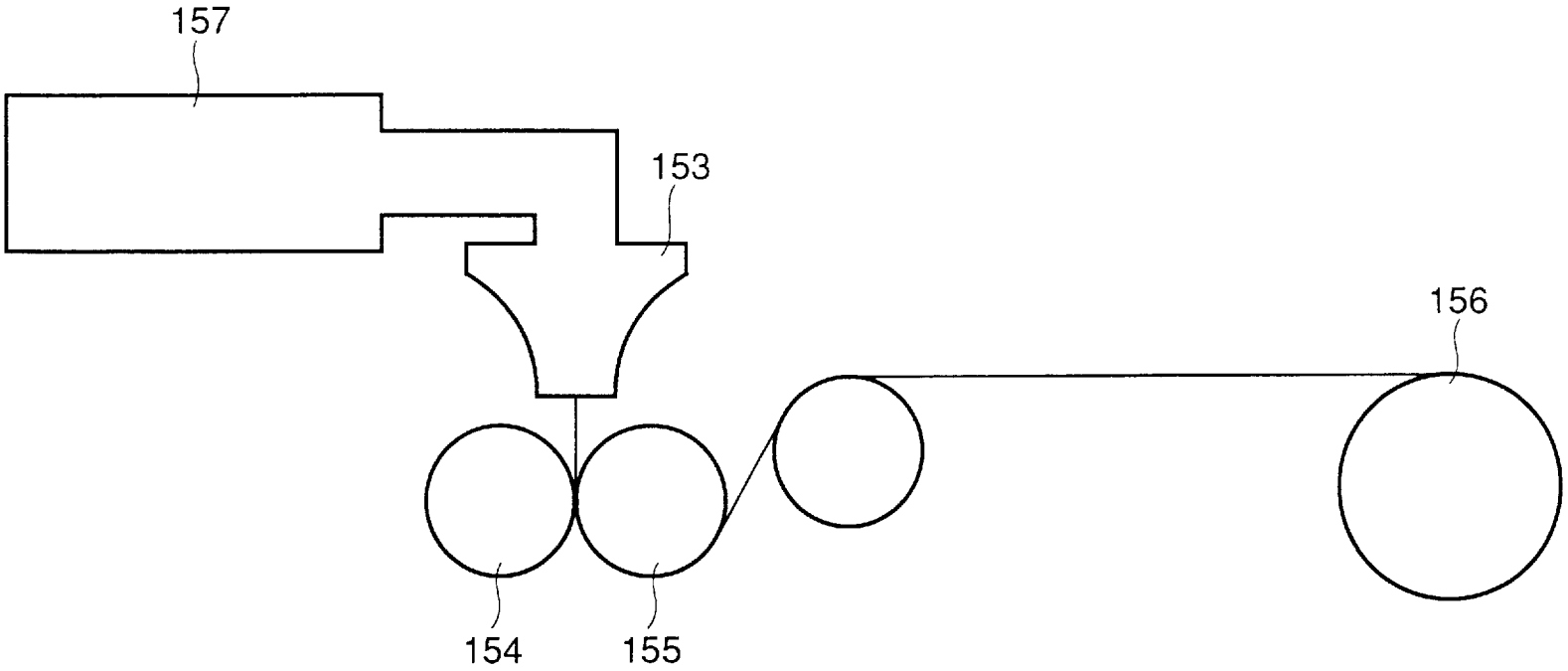
FIG. 6 is a view showing an example of an apparatus for manufacturing the transfer belt of FIG. 2.

FIG. 2 is a sectional view showing a transfer sheet (transfer belt) according to the second embodiment, and FIG. 6 is a view showing an example of an apparatus for manufacturing such a transfer sheet.

In the transfer belt 8, as shown in FIG. 2, a large amount of carbon is included in a central portion more than an upper surface portion and a lower surface portion so that the entire volume resistivity of the belt becomes $10^{14}$ Ωcm or more and the surface resistivity at the upper and lower surfaces becomes $10^{7}$ to $10^{13}$ Ω/□. In the second embodiment, as is in the first embodiment, polycarbonate and kechen carbon are used as the resin and carbon. Further, the kechen carbon of 8% is dispersed in the polycarbonate resin, and the material is extruded to form a sheet having a thickness of 150 μm by using the apparatus shown in FIG. 6. The manufacturing apparatus has an extruder 157 in which the resin material is extruded from a die 153, and the extruded sheet is cooled while it is being passed between pressure rollers 154 and 155. Thereafter, the sheet is wound around a take-up reel 156. This is a conventional extruding/molding apparatus.

Figure 3:
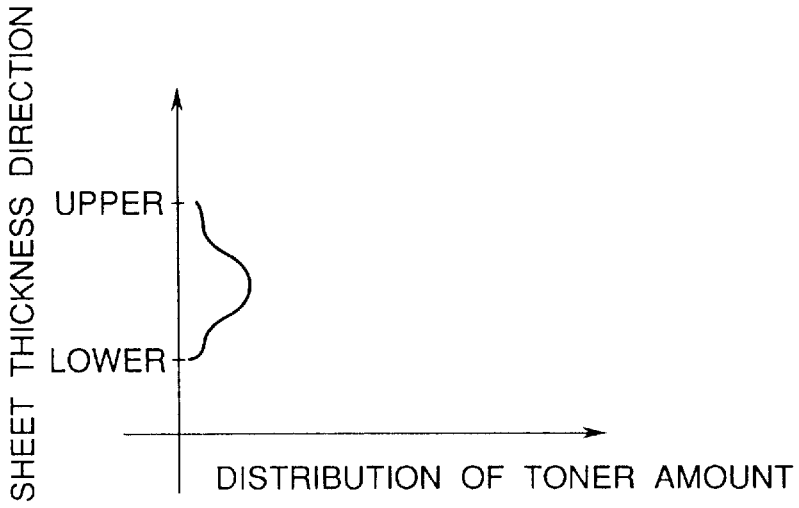
FIG. 3 is a graph showing a relation between distribution of carbon amount and a sheet thickness direction regarding the transfer belt of FIG. 2.

In such a conventional extruding/molding apparatus, the polycarbonate resin is oriented to enhance the crystallization. Due to such crystallization, the distribution of the dispersed carbon (kechen black) in a sheet thickness direction becomes as shown in FIG. 3. That is, the carbon amount is greater at a central portion than at upper and lower surface portions. Thus, the transfer belt as shown in FIG. 2 can be obtained by using this sheet.

In the second embodiment, a belt having the entire volume resistivity of $5\times10^{14}$ Ωcm and the surface resistivity (at upper and lower surfaces) of $3\times10^{10}$ Ω/□ is used as the transfer belt 8 shown in FIG. 2 and this belt is used in the image forming apparatus of FIG. 5. In this condition, the image forming operation was effected, it was found that the good image can be obtained without the re-transferring of toner.

Further, the transfer belt 8 of FIG. 2 can be used as the intermediate transfer belt 8*b* and the transfer belt 8*a* of FIG. 2, and the transfer material bearing sheet 111 of FIG. 8.

Next, a third embodiment of the present invention will be explained.

Figure 4:
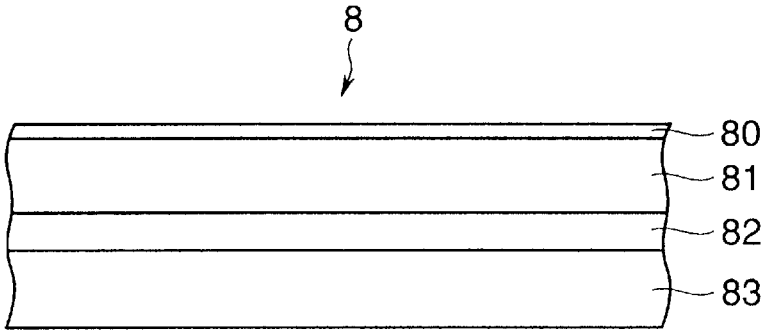
FIG. 4 is a partial sectional view of a transfer belt according to a further embodiment of the present invention.

The transfer sheet such as the above-mentioned transfer material bearing member and intermediate transfer member is not limited to three layers or less. An example of a transfer sheet (such as a transfer material bearing member and an intermediate transfer member) having a four-layer structure will be described hereinbelow. FIG. 4 is a sectional view of a transfer sheet (transfer belt) according to the third embodiment.

In the third embodiment, in order to improve the toner peeling ability of the transfer belt 8, a fluororesin layer 80 having a thickness of 10±5 μm is coated on the upper layer 81 of the transfer belt 8 of FIG. 1. In this case, although the surface resistivity ρs of the surface of the transfer belt 8 is increased, so long as $\rho s \leqq 10^{13}$ Ω/□, the good result can be obtained.

In the third embodiment, as mentioned above, since the toner peeling ability is improved by the presence of the fluororesin layer 80, for example, the transferring ability when the belt is used as the intermediate transfer belt 8*b* of FIG. 7 and the cleaning ability when the belt is used as the transfer material bearing transfer belt 8*a* of FIG. 7 can also be improved. Further, the transfer belt 8 of FIG. 4 can be used as the transfer belt 8 of FIG. 5, the intermediate transfer belt 8*b* of FIG. 7 and the transfer material bearing sheet 111 of FIG. 8.

According to the present invention, in all of the above-mentioned embodiments, the technical advantages as mentioned can be obtained, and further, since the upper and lower surfaces of the transfer material bearing member and the intermediate transfer member are dielectric, mechanical strength and physical stability can be obtained. For example, even when the surface resistivity of the transfer sheet is smaller than $10^7$ Ω/□ and the volume resistivity of the transfer sheet is greater than $10^{14}$ Ωcm, if the surface of the sheet is worn during the long term usage, the electric feature is greatly changed. To the contrary, according to the present invention, since the change in the electric feature due to the wear of the surface of the transfer sheet is small, the desired technical effect can stably be achieved for a long time.

Further, in a transfer sheet used in an image forming apparatus in which images are formed on both surfaces of each transfer material, conventionally, as disclosed in the Japanese Patent Application Laid-Open No. 6-130712, a surface of the sheet has been roughly finished. Also regarding such a transfer sheet, by applying the electric feature of the transfer sheet of the present invention to such a conventional sheet, electrical stability can be achieved.

Preferably, the transfer sheet such as the above-mentioned transfer material bearing member, and intermediate transfer member has the volume resistivity of $10^{16}$ Ωcm or less and the thickness of 200 μm or less.

What is claimed is:

1. An image forming apparatus comprising:

image bearing means for bearing an image thereon; and a transfer material bearing member for bearing a transfer material thereon to which the image is transferred from said image bearing means;

wherein a volume resistivity of said transfer material bearing member is $10^{14}$ Ωcm or more, and a surface resistivity of an upper surface and a lower surface of said transfer material bearing member is $10^7$ to $10^{13}$ Ω/□.

2. An image forming apparatus according to claim 1, wherein said transfer material bearing member includes a first layer and a second layer each constituting said upper and lower surfaces and having a volume resistivity of $10^9$ Ωcm or more, and a third layer disposed between said first and second layers and having a volume resistivity of $10^3$ to $10^7$ Ωcm.

3. An image forming apparatus according to claim 1, wherein said transfer material bearing member includes a dielectric body and a conductive filler dispersed in said dielectric body, and a density of said conductive filler is greater at an inner side than an upper surface side and a lower surface side of said transfer material bearing member.

4. An image forming apparatus according to claim 1, wherein the volume resistivity of said transfer material bearing member is $10^{16}$ Ωcm or less, and a thickness of said transfer material bearing member is 200 μm or less.

5. An image forming apparatus according to claim 1, wherein said image bearing means has a plurality of image bearing members each for bearing different color images to be transferred from said plurality of image bearing members to the transfer material borne on said transfer material bearing member in a superimposed fashion.

6. An image forming apparatus according to claim 5, further comprising a plurality of developing devices for effecting developing operations for each of the plurality of corresponding image bearing members, wherein each of said plurality of developing devices effects the developing operation and a cleaning operation for cleaning the corresponding image bearing member.

7. An image forming apparatus according to claim 1, wherein said image bearing means has a single image bearing member on which plural color images are formed to be transferred from said image bearing member to the transfer material borne on said transfer material bearing member in a superimposed fashion.

8. An image forming apparatus comprising:

an image bearing member for bearing an image thereon; and an intermediate transfer member to which the image is transferred from said image bearing member and which is adapted to transfer the image to a transfer material;

wherein a volume resistivity of said intermediate transfer member is $10^{14}$ Ωcm or more, and a surface resistivity of an upper surface and a lower surface of said intermediate transfer member is $10^{7}$ to $10^{13}$ Ω/□.

9. An image forming apparatus according to claim 8, wherein said intermediate transfer member includes a first layer and a second layer constituting said upper and lower surfaces and having a volume resistivity of $10^{9}$ Ωcm or more, and a third layer disposed between said first and second layers and having a volume resistivity of $10^{3}$ to $10^{7}$ Ωcm.

10. An image forming apparatus according to claim 8, wherein said intermediate transfer member includes a dielectric body and a conductive filler dispersed in said dielectric body, and a density of said conductive filler is greater at an inner side than an upper surface side and a lower surface side of said intermediate transfer member.

11. An image forming apparatus according to claim 8, wherein the volume resistivity of said intermediate transfer member is $10^{16}$ Ωcm or less, and a thickness of said intermediate transfer member is 200 μm or less.

12. An image forming apparatus according to claim 8, wherein plural color images are formed on said image bearing member to be transferred from said image bearing member to said intermediate transfer member.

13. A transfer sheet, having a volume resistivity of not less than $10^{14}$ Ωcm, is comprised of (1) a first layer and a second layer disposed on a front surface and a rear surface of said transfer sheet and having a surface resistivity in a range of $10^{7}$ to $10^{13}$ Ω/□ and having a volume resistivity of not less than $10^{9}$ Ωcm, and (2) a third layer disposed between said first and second layers and having a volume resistivity in a range of $10^{3}$ to $10^{7}$ Ωcm.

14. A transfer sheet, having a volume resistivity of not less than $10^{14}$ Ωcm and having a surface resistivity of a front surface and a rear surface in a range of $10^{7}$ to $10^{13}$ Ω/□, is comprised of a dielectric member and a conductive filler to be dispersed into said dielectric member, wherein a density of said conductive filler is larger at an inner portion than at the front and rear surfaces of said transfer sheet.

15. A transfer sheet, having a volume resistivity in a range of $10^{14}$ to $10^{16}$ Ωcm and having a surface resistivity of a front surface and a rear surface of $10^{7}$ to $10^{13}$ Ω/□, has a thickness of not more than 200 μm.

* * * * *

UNITED STATES PATENT AND TRADEMARK OFFICE

CERTIFICATE OF CORRECTION

PATENT NO. : 5,832,351

DATED : November 3, 1998

INVENTOR(S) : NOBUHIKO TAKEKOSHI, ET AL.

It is certified that error appears in the above-identified patent and that said Letters Patent is hereby corrected as shown below:

COLUMN 2,
Line 58, "the" (first occurrence) should be deleted, and "of" should be deleted; and
Line 66, "of" should be deleted.

Signed and Sealed this

Twenty-second Day of June, 1999

*Attest:*

Q. TODD DICKINSON

*Attesting Officer*

*Acting Commissioner of Patents and Trademarks*